US005537124A

United States Patent [19]

Rankin, Jr. et al.

[11] Patent Number: 5,537,124

[45] Date of Patent: Jul. 16, 1996

[54] TRANSLATION CANCELLING VERTICAL SENSING SYSTEM

[75] Inventors: Robert C. Rankin, Jr., Severn; William B. Evans, Marriottsville, both of Md.

[73] Assignee: Northrop Grumman, Los Angeles, Calif.

[21] Appl. No.: 320,353

[22] Filed: Oct. 11, 1994

[51] Int. Cl.[6] ..... H01Q 3/00

[52] U.S. Cl. ..... 343/763; 343/765; 342/355

[58] Field of Search ..... 343/709, 757, 343/765, 766, 878, 880; 342/359, 352, 355; 250/548, 559.29, 559.37

[56] References Cited

U.S. PATENT DOCUMENTS 4,156,241 5/1979 Mobley et al. ..... 342/352
4,334,226 6/1982 Eguchi et al. ..... 342/355
4,920,350 4/1990 McGuire et al. ..... 343/766
5,419,521 5/1995 Matthews ..... 343/765

*Primary Examiner*—Donald T. Hajec
*Assistant Examiner*—V. Tantto
*Attorney, Agent, or Firm*—C. O. Edwards

[57] ABSTRACT

A rotating antenna system subject to both tilt and translation forces includes first and second tilt sensors each having a pendulum assembly of a different length than the other sensor. The sensors provide identical output signals in response to a tilt, but different output signals in response to a translation of the antenna. Circuitry is provided for eliminating the effects of translation so as to obtain a tilt angle correction signal for correcting the radar height calculation.

8 Claims, 5 Drawing Sheets

TRANSLATION CANCELLING VERTICAL SENSING SYSTEM

BACKGROUND OF THE INVENTION

1. Field of the Invention

The invention in general relates to a vertical sensing system for a structure, and more particularly to a system which provides an output signal indicative of structure tilt, while eliminating any output signal which may be due to a lateral movement of the structure.

2. Description of Related Art

It is often desired to obtain an indication of the pitch or tilt angle of a structure in order to initiate a corrective action, if required. By way of example, various deployable radar systems include a vertical tilt sensor cooperative with the radar antenna to allow radar height measurements to be corrected for static as well as dynamic tilt of the antenna structure during operation.

A static tilt of the antenna from a pure vertical orientation may be present due to the fact that the antenna is not perfectly levelled each time it is deployed. Such static tilt may also change during operation due to settling of the antenna. Dynamic tilt of the antenna results from deflections in the antenna structure caused by wind forces.

In these radar systems, the tilt sensor will provide an output signal indicative of antenna tilt to correct the radar measurements of the height to a distant target, which in the absence of such correction would result in an erroneous target indication.

A problem arises however in that the fast response time of the tilt sensor also makes it sensitive to dynamic horizontal lateral movements which also result from the wind forces. This horizontal translation of the antenna has no significant effect on radar height performance and accordingly any translation detected by the sensor will result in erroneous correction of the height measurements. The present invention provides a solution to this problem.

SUMMARY OF THE INVENTION

Apparatus, in accordance with the present invention, for determining the tilt angle of a structure subject to both tilt and translation movement includes first and second tilt sensors positioned on the structure, with each sensor being operable to provide an output signal which includes not only a tilt angle component but also a component due to translation, if present. The first and second sensors have the same response due to a tilting of the structure but are constructed and arranged to have different responses due to a translation of the structure. Circuit means are provided which utilizes the different responses to derive a tilt angle signal indicative of only the tilt angle component. The tilt angle signal may then be used for correctional purposes.

DESCRIPTION OF THE PREFERRED EMBODIMENT

Figure 1:
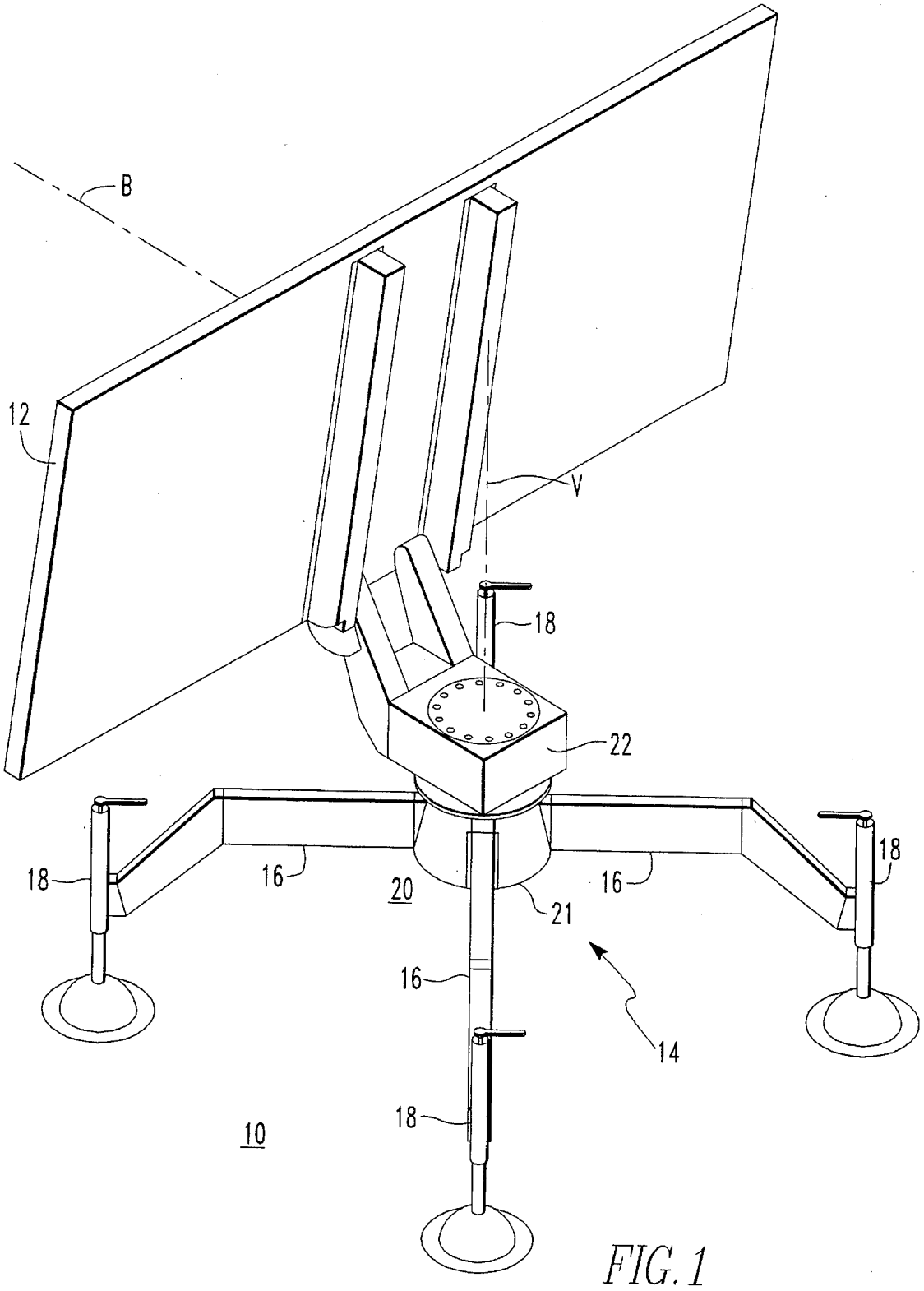
FIG. 1 is a rear view of an antenna structure in which the present invention may be utilized.

The present invention has applicability to a variety of structures, however it will be described by way of example with respect to a deployable antenna system 10 illustrated in FIG. 1. The system includes a rotating antenna 12 which projects and receives energy along a beam axis B for detection of distant targets.

The antenna system 10 includes a base assembly 14 having a plurality of structural supports 16 each of which has one end connected to a levelling jack 18. The other end of each support 16 terminates in a pedestal assembly 20 having a stationary portion 21 and a rotating portion 22 which rotates around a nominally vertical axis V. A nearby control center (not illustrated) is in constant electronic communication with the antenna system.

Figure 2:
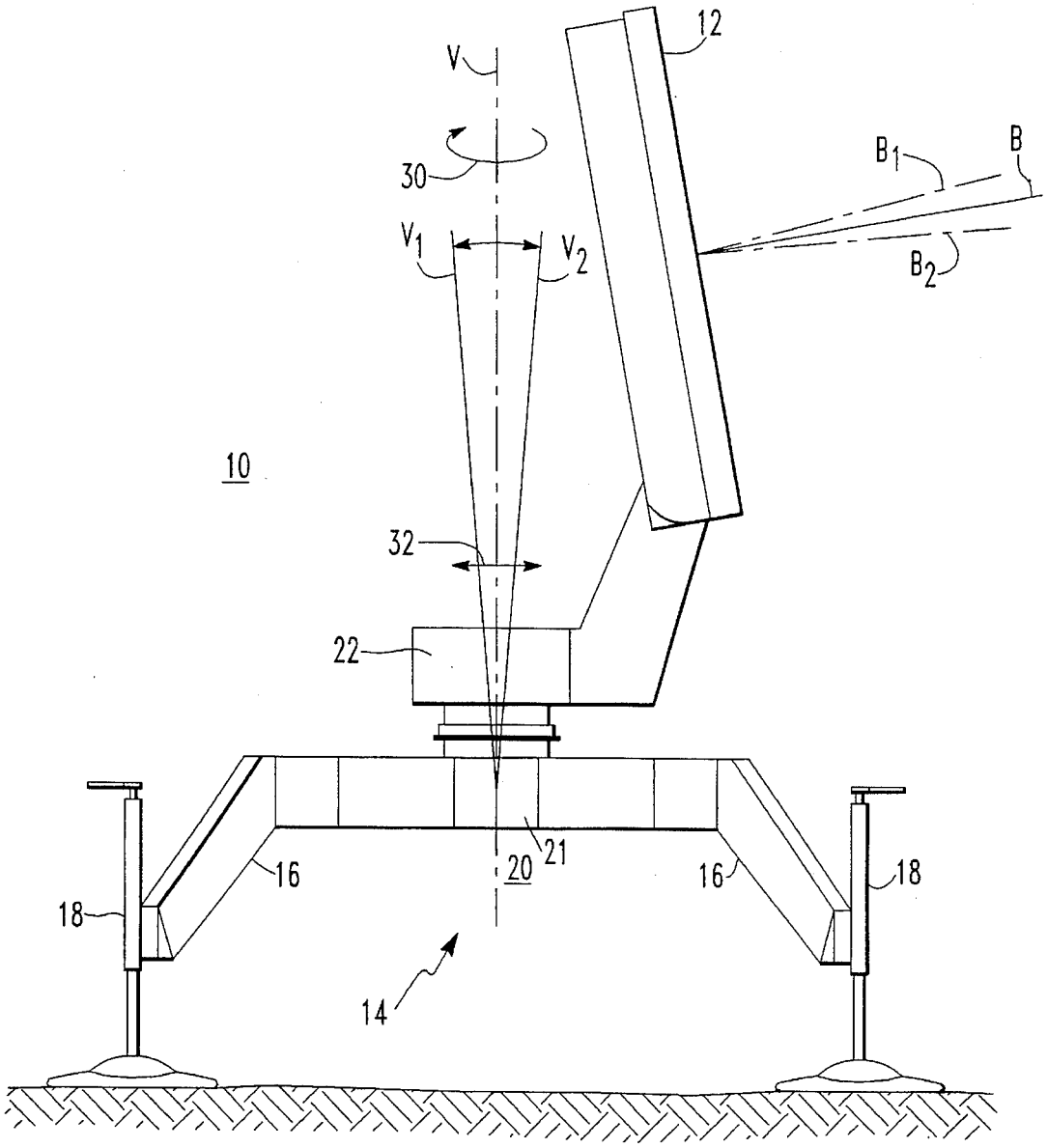
FIG. 2 is a side view of the antenna of FIG. 1.

FIG. 2 is a side view of the system of FIG. 1 and serves to illustrate one problem which may be encountered with such deployable systems. Rotation of the antenna 12 is around the vertical axis V, as indicated by arrow 30. Deviation from vertical may be due to the fact that the antenna is not perfectly levelled when it is deployed and once deployed, this deviation, or static tilt may change due to settling of the antenna system. Further, dynamic tilt of the antenna results from deflections in the antenna structure caused by wind forces.

Static or dynamic tilt may cause the vertical axis to assume a position anywhere between $V_1$ and $V_2$ (shown grossly exaggerated). Such tilt also causes the antenna beam axis B to vary between positions $B_1$ and $B_2$. For a three-dimensional radar system (heading, range, height), a slight deviation of the beam axis can result in a target error. For example, a mere 0.1 degree error would, at 100 miles, result in a height error for the target of over 900 feet.

The same wind forces that cause dynamic tilt may also cause a slight lateral movement of the antenna structure, as indicated by the arrow 32. This lateral movement, or translation, for all practical purposes does not have an effect on target measurements, as does the antenna tilting.

If the tilt angle of the antenna is known, then the beam signal can be modified as a function of the tilt angle to correct for beam error. One common way of making this correction is with the use of a tilt sensor which may be positioned within the stationary portion 21 of the pedestal assembly 20 on, or in close proximity to, the vertical axis V.

Figure 3:
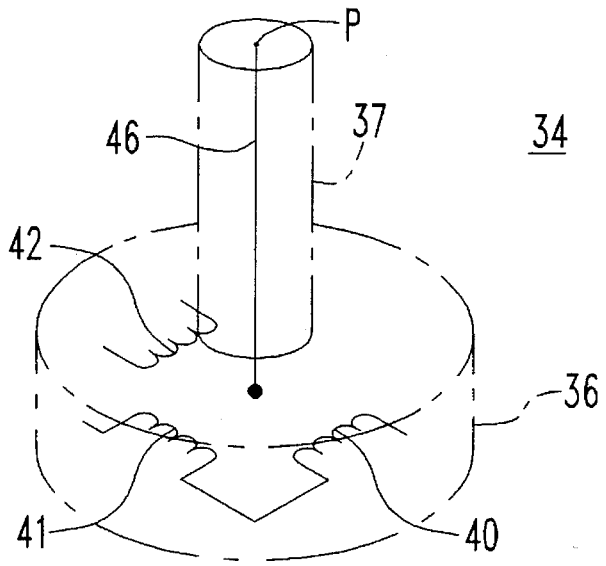
FIG. 3 is a schematic representation of a pendulum type tilt sensor which is utilized herein.

A simplified schematic representation of a well known commercially available tilt sensor is illustrated in FIG. 3. The sensor 34 includes a base 36 and a coaxial elongated cylindrical section 37. Disposed within the base are first and second orthogonal sense coils 40 and 41 as well as an excitation coil 42. A pendulum assembly 46 connected at pivot point P hangs and is movable within the cylindrical section 37. Any tilting of the sensor caused by tilting of the structure to which it is connected causes the pendulum assembly to modify its position relative to either or both of sense coils 40 and 41 to thereby vary their electrical response. Each coil provides an output signal which is indicative of the resultant tilt of the sensor 34.

Figure 4:
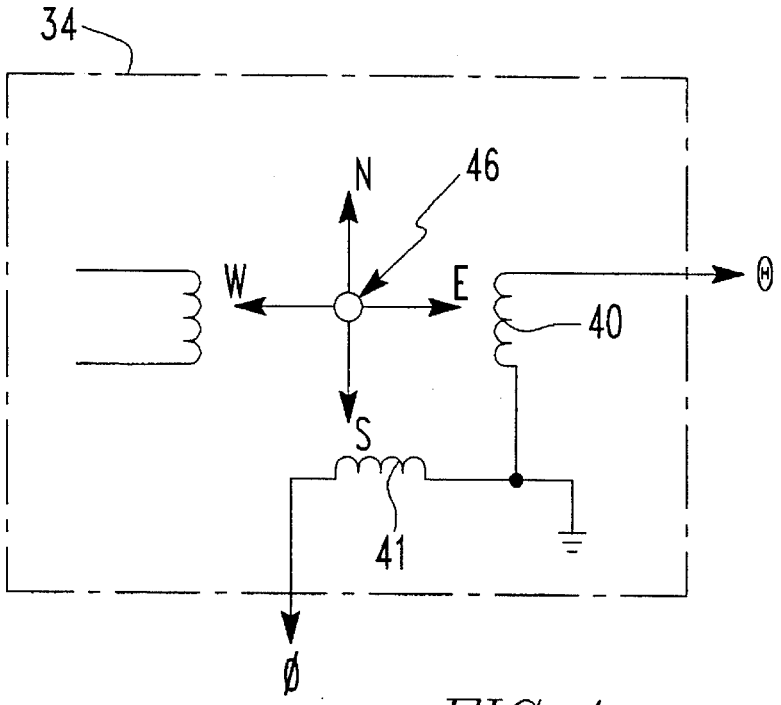
FIG. 4 is a simplified electrical schematic of the sensor of FIG. 3.

More specifically, and as illustrated in FIG. 4, with the sensor positioned on the antenna assembly of FIG. 2, any tilting of the assembly in the east–west direction will cause coil 40 to provide an output signal $\theta$ indicative of such deviation from normal. Similarly, any deviation from vertical in the north–south direction will cause coil 41 to provide an output signal $\phi$ indicative of such deviation. Movement of the pendulum assembly 46 in other directions will result in output signals $\theta$ and $\phi$ indicative of the east–west and north–south components of such movement. For commercially sold sensors, coil 40 is often referred to as the pitch-axis coil while coil 41 is the roll-axis coil.

It may be seen that with the tilt sensor, any translation of the antenna system will also cause movement of the pendulum relative to one or both of the sense coils, due to the moment of inertia of the pendulum assembly, thereby providing an output signal which is completely unrelated to tilt. With the sensor signal being utilized to modify the radar height calculation, an overcorrection will occur resulting in degraded height performance under windy conditions.

In the present invention this degraded performance is eliminated by apparatus which obtains an indication of tilt even though the tilt sensor may be providing an output signal which has a component due to translation of the structure.

Figure 5A:
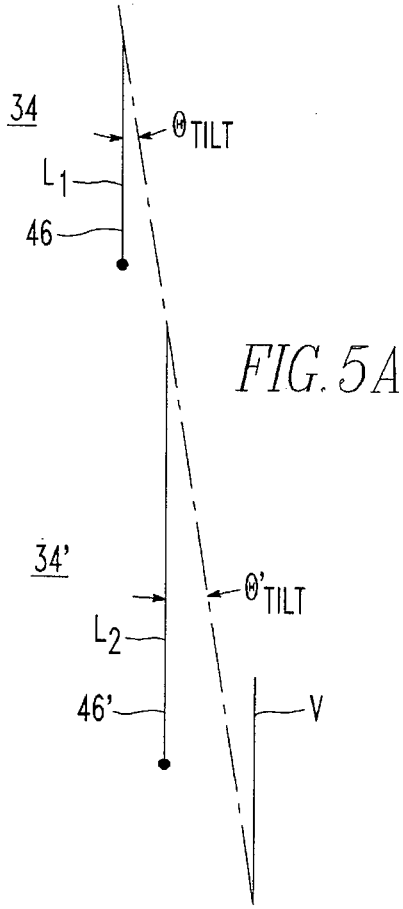
FIG. 5A illustrates operation of a tilt sensor under a condition of tilt.

In the present invention two tilt sensors are utilized and may be of the types previously described in FIG. 3. In FIG. 5A, with a deviation from the vertical axis V due only to tilt, the first sensor 34 having a pendulum assembly 46 of length $L_1$ will provide a tilt angle indication of $\theta_{tilt}$. The second sensor 34' with a pendulum assembly 46' of length $L_2$ will provide a tilt angle indication of $\theta'_{tilt}$ where $\theta_{tilt}=\theta'_{tilt}$.

Figure 5B:
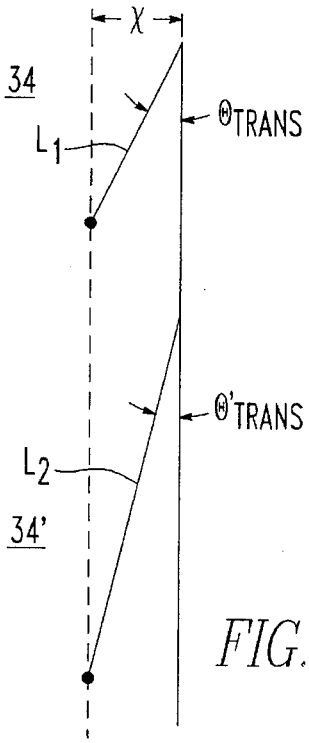
FIG. 5B illustrates the operation of the sensor under a condition of translation.

In FIG. 5B let it be assumed that the pendulum assemblies 46 and 46' of sensors 34 and 34' have been in a vertical orientation and are quickly translated from the dotted line position by a distance x. Whereas in FIG. 5A, the two sensors had the same response due to a tilting, in FIG. 5B the angles $\theta_{trans}$ and $\theta'_{trans}$, which are due only to translation, are different. The two sensors respond differently to a translation due to the fact that $L_2$ is different than $L_1$. For small angles, the ratio $\theta_{trans}/\theta'_{trans}$ very closely approximates the ratio $L_2/L_1$.

Figure 5C:
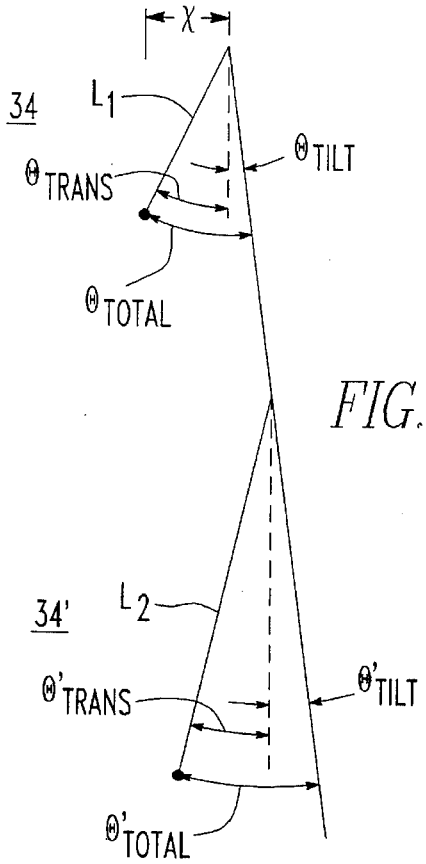
FIG. 5C illustrates the total angles involved in both a tilt and translation.

Accordingly, with the two sensors positioned within the base assembly of the antenna system as in FIG. 2, each sensor, when the antenna is subject to wind forces, may provide an output signal which not only has a tilt angle component but also a component due to the translation. These angles are illustrated in FIG. 5C where it is seen that sensor 34 provides an output signal $\theta_{total}=\theta_{tilt}+\theta_{trans}$ and sensor 34' provides an output signal $\theta'_{total}=\theta'_{tilt}+\theta'_{trans}$. Since $\theta_{tilt}$ and $\theta'_{tilt}$ are equal and $\theta_{trans}/\theta'_{trans}$ very closely equals $L_2/L_1$, the sensor outputs $\theta_{total}/\theta'_{total}$ can be combined with a suitable electric circuit such that $\theta_{trans}$ is made equal and opposite to $\theta'_{trans}$, thus cancelling out and leaving only the desired $\theta_{tilt}$ output signal. These signals would be provided by the coils which are responsive to the east–west component of movement in the sensors while a similar set of signals with a $\phi$ designation, would be provided for the north–south component of any movement.

Examining the east–west signal components, from geometry, and for the small tilt angles involved, it may be shown that:

$$\theta_{tilt}=\frac{\left(\frac{L_2}{L_1}\right)(\theta'_{total})-\theta_{total}}{\left(\frac{L_2}{L_1}\right)-1} \tag{1}$$

where:

$\theta_{tilt}$ equals the tilt angle component required for correction of the radar signal;

$L_2$ equals the length of the pendulum assembly of sensor 34';

$L_1$ equals the length of the pendulum assembly of sensor 34;

$\theta'_{total}$ equals the output of sensor 34'; and $\theta_{total}$ equals the output of sensor 34.

Figure 6:
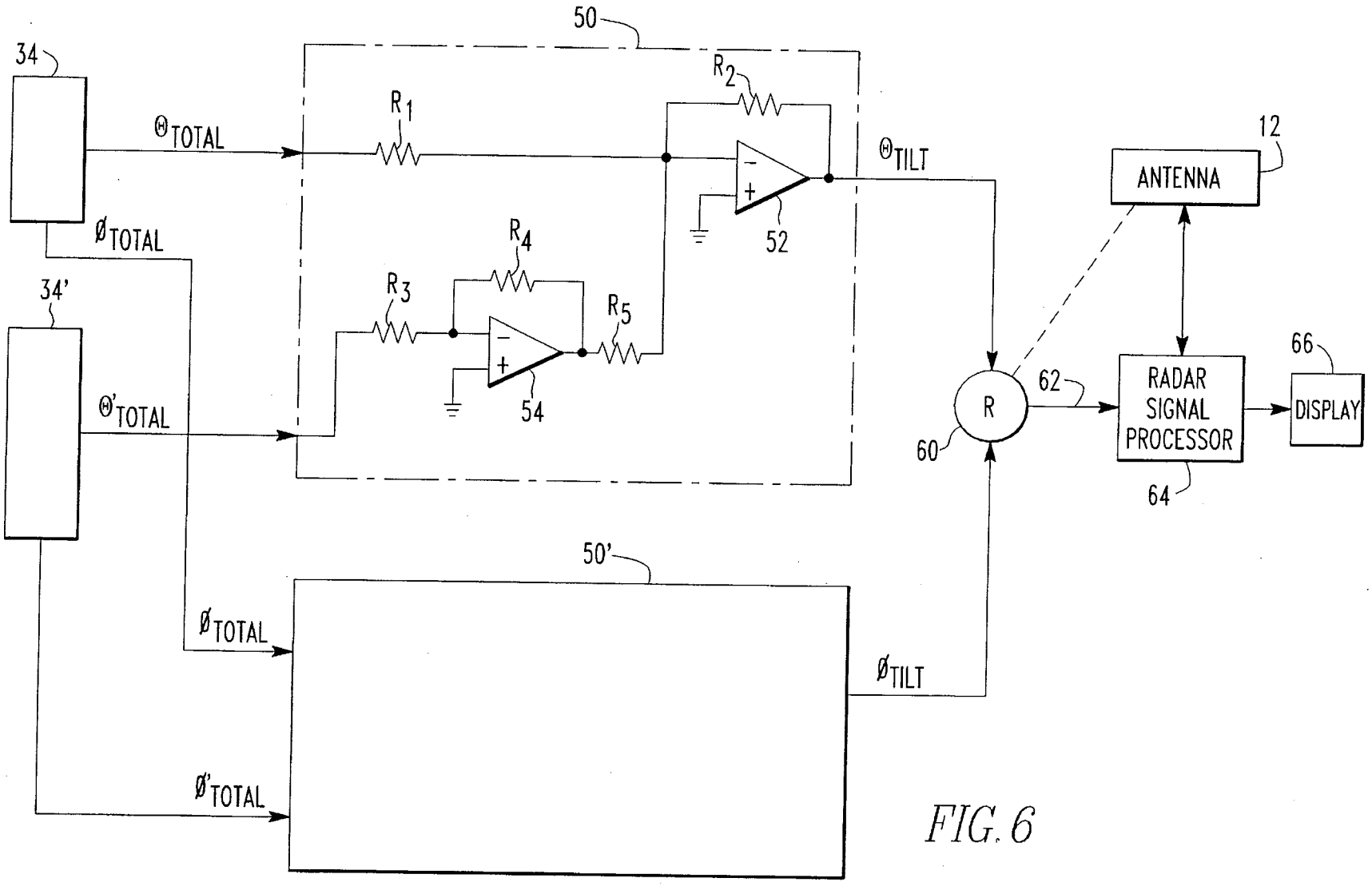
FIG. 6 illustrates an electrical circuit for deriving a tilt angle signal used for correctional purposes.

It is seen therefore that the desired component required for signal correction, $\theta_{tilt}$, may be derived knowing the outputs of both sensors, and which output includes both tilt as well as translation components. The desired tilt angle component may be derived utilizing signal processing circuitry one example of which is illustrated in FIG. 6, to which reference is now made.

Tilt angle signal processing circuit 50 is responsive to the $\theta$ output signals of the two sensors to derive a tilt angle component in the east–west direction, and similar tilt angle signal processing circuitry 50' is responsive to the $\phi$ output signals from the two sensors to derive the north–south tilt angle component $\phi$.

Circuit 50, as shown in simplified form, includes a first amplifier 52 having a feedback resistor $R_2$ and an input resistor $R_1$ to which the signal $\theta_{total}$ is applied. The second amplifier 54 with an output resistor $R_5$ includes a feedback resistor $R_4$ and an input resistor $R_3$ to which the $\theta'_{total}$ signal is applied. From the relationship of equation (1), the gain applied to the signal $\theta_{total}$ is:

$$\frac{R_2}{R_1}=\frac{1}{\left(\frac{L_2}{L_1}\right)-1} \tag{2}$$

and the gain applied to the signal $\theta'_{total}$ is:

$$\left(\frac{R_4}{R_3}\right)\left(\frac{R_2}{R_5}\right)=\frac{\left(\frac{L_2}{L_1}\right)}{\left(\frac{L_2}{L_1}\right)-1} \tag{3}$$

$R_1$ may be selected based upon standard electric circuit design considerations taking into account leakage current, saturation voltage, amplifier characteristics, et cetera. Once having selected $R_1$, $R_2$ may be determined utilizing equation (2). The resistance ratio $R_4/(R_3)(R_5)$ is obtained based again on standard circuit design considerations. Alternatively, the sensor output signals may be converted to digital form and the tilt angle solution obtained by digital signal processing.

The rotating antenna 12 is coupled by means of an antenna drive motor to a resolver 60 which receives the east–west and north–south tilt indications from circuits 50 and 50' and is operable to resolve these outputs into a vector in the direction in which the antenna is pointing. This resultant output signal on line 62 is provided to a utilization means, which in the instant case would be a radar signal processor 64 which utilizes the correction to provide an output on display 66, by way of example. For an antenna system which is non-rotating, circuit 50' and resolver 60 would not be required.

We claim:

1. Apparatus for determining the tilt angle of a structure subject to both tilt and translation movement, comprising:

a) first and second tilt sensors positioned on said structure and each operable to provide an output signal which includes not only a tilt angle component but also a component due to said translation;

b) said first and second sensors having the same response due to a tilting of said structure but different responses due to a translation of said structure;

c) means utilizing said different responses due to said translation to derive a tilt angle signal indicative of said tilt angle component; and d) means for utilizing said tilt angle signal.

2. Apparatus according to claim 1 wherein:

said first and second tilt sensors are of the type which includes at least one sense coil and a pendulum;

the length of the pendulum of said first sensor being of a different length than the pendulum of said second sensor.

3. Apparatus according to claim 2 wherein:

said sensors are of the type which includes first and second orthogonal sense coils for obtaining east–west and north–south signal components.

4. Apparatus according to claim 3 wherein:

said structure is a radar antenna operable to provide an output signal in response to energy reflected from, and indicative of, a distant target.

5. Apparatus according to claim 4 wherein:

said antenna is a rotating antenna.

6. Apparatus for determining the instantaneous tilt angle of a rotating radar antenna of an antenna system and subject to both tilt and translation movement during said rotation, comprising:

a) sensor means positioned on a non-rotating portion of said antenna system and operable to provide a plurality of output signals indicative of movement in an east–west direction as well as a north–south direction, and each having not only a tilt angle component but an undesired component due to said translation;

b) circuit means responsive to said plurality of output signals to derive first and second output signals indicative, respectively, of tilt angle in said east–west direction and said north–south direction and without said signal component due to translation;

c) means for resolving said first and second signals into a resultant vector signal; and d) means for utilizing said vector signal.

7. Apparatus according to claim 6 wherein:

said sensor means includes first and second biaxial sensors.

8. Apparatus according to claim 7 wherein:

said first and second sensors are of the type which includes first and second orthogonal sense coils and a pendulum;

the pendulum of said first sensor being of a different length than the pendulum of said second sensor.

* * * * *